US009475102B2

(12) United States Patent
de Amblia

(10) Patent No.: US 9,475,102 B2
(45) Date of Patent: Oct. 25, 2016

(54) KEG WASHERS

(71) Applicant: Global Stainless Systems, Inc., Canby, OR (US)

(72) Inventor: Guinevere de Amblia, Oregon City, OR (US)

(73) Assignee: Advanced Cutting Solutions, Inc., Beaverton, OR (US)

( * ) Notice: Subject to any disclaimer, the term of this patent is extended or adjusted under 35 U.S.C. 154(b) by 1060 days.

(21) Appl. No.: 13/632,858

(22) Filed: Oct. 1, 2012

(65) Prior Publication Data

US 2013/0081661 A1 Apr. 4, 2013

Related U.S. Application Data

(60) Provisional application No. 61/541,750, filed on Sep. 30, 2011.

(51) Int. Cl.
*B08B 9/08* (2006.01)

(52) U.S. Cl.
CPC ..... *B08B 9/0826* (2013.01)

(58) Field of Classification Search
CPC ..... B67D 1/0832; B08B 9/0804; Y10T 137/314; Y10T 137/6137; B67C 3/30
USPC ..... 141/92, 113, 89, 1, 91, 18, 2, 5, 301, 141/350; 134/166 R, 167 R, 22.18, 57 R, 62, 134/22.1; 222/400.7, 394, 592.19; 137/212, 137/322, 240, 12.5, 312
See application file for complete search history.

(56) References Cited

U.S. PATENT DOCUMENTS 2,522,310 A * 9/1950 Smith ..... B08B 9/0843 134/152
3,166,106 A 1/1965 Reeve et al.
3,277,929 A * 10/1966 Cook ..... B08B 9/0804 134/43
3,454,018 A * 7/1969 Ruddick ..... B08B 9/0804 134/133
3,470,891 A * 10/1969 Ruddick ..... B08B 9/0804 134/166 R
3,563,287 A * 2/1971 Ruddick ..... B67C 3/34 141/113
3,564,584 A 2/1971 Ruddick
3,605,768 A 9/1971 Golding
3,648,742 A 3/1972 Beech
3,791,425 A 2/1974 Bowring
3,831,645 A * 8/1974 Golding ..... B67C 3/34 141/171
3,907,011 A 9/1975 Edmunds
4,102,450 A * 7/1978 Chapman ..... B08B 9/0804 198/774.2
4,319,612 A * 3/1982 Golding ..... B67C 3/30 141/1
4,333,504 A * 6/1982 Golding ..... B67C 3/32 141/302
4,573,505 A * 3/1986 Lee ..... B67C 3/34 141/273
5,000,661 A * 3/1991 Bloch ..... B67C 7/0006 141/1
5,458,166 A 10/1995 Kronseder
5,613,713 A 3/1997 Gysi et al.
5,634,501 A 6/1997 Walshe

* cited by examiner

*Primary Examiner* — David Cormier
*Assistant Examiner* — Thomas Bucci
(74) *Attorney, Agent, or Firm* — Kolisch Hartwell, P.C.

(57) ABSTRACT

Keg washers and locking mechanisms for keg washers are disclosed. The keg washers may include a base assembly, a cleaning head, a head mechanism, and a locking mechanism configured to secure the keg to the base assembly. The locking mechanism may include a holder mechanism and a neck holder fixedly mounted to the holder mechanism. The neck holder may include a first opening and a second opening. The holder mechanism may be configured, when the cleaning head is moved from a retracted position toward an extended position, to move the neck holder from a first position in which a first neck portion of a keg is received in the first opening but a second neck portion is not received in the second opening, to a second position in which the first neck portion is received in the first opening and the second neck portion is received in the second opening.

18 Claims, 9 Drawing Sheets

KEG WASHERS

CROSS-REFERENCE TO RELATED APPLICATION

This application claims priority to U.S. Provisional Patent Application Ser. No. 61/541,750 entitled "Keg Washers," which was filed on Sep. 30, 2011. The complete disclosure of the above application is hereby incorporated by reference for all purposes.

BACKGROUND OF THE DISCLOSURE

Kegs may provide a convenient way of storing fluids, such as beer, other alcoholic drinks, and non-alcoholic drinks, under pressure. Beer kegs are made of stainless steel (or aluminum) and have a single opening on one end. A tube or "spear" extends from that opening to the other end. The keg includes a self-closing valve that is opened by the coupling fitting that is attached when the keg is tapped. The top of the spear also includes an opening that allows gas, such as carbon dioxide, to drive the beer out of the keg. The coupling fitting has one or two valves that control flow of beer out of and gas into the keg. The keg must be in an upright position, or with the opening on top, for the beer to be dispensed. Used kegs must be cleaned and sanitized prior to refilling those kegs with new fluids. Keg washers may be used to clean and sanitize those kegs.

Examples of container washers, including keg washers are disclosed in U.S. Pat. Nos. 5,634,501; 5,613,713; 5,458,166; 4,319,612; 3,907,011; 3,791,425; 3,648,742; 3,605,768; 3,564,584; 3,563,287; 3,470,891; 3,454,018; 3,277,929; 3,166,106; and 2,522,310. The complete disclosures of the above patents are hereby incorporated by reference for all purposes.

DETAILED DESCRIPTION OF THE DISCLOSURE

Figure 1:
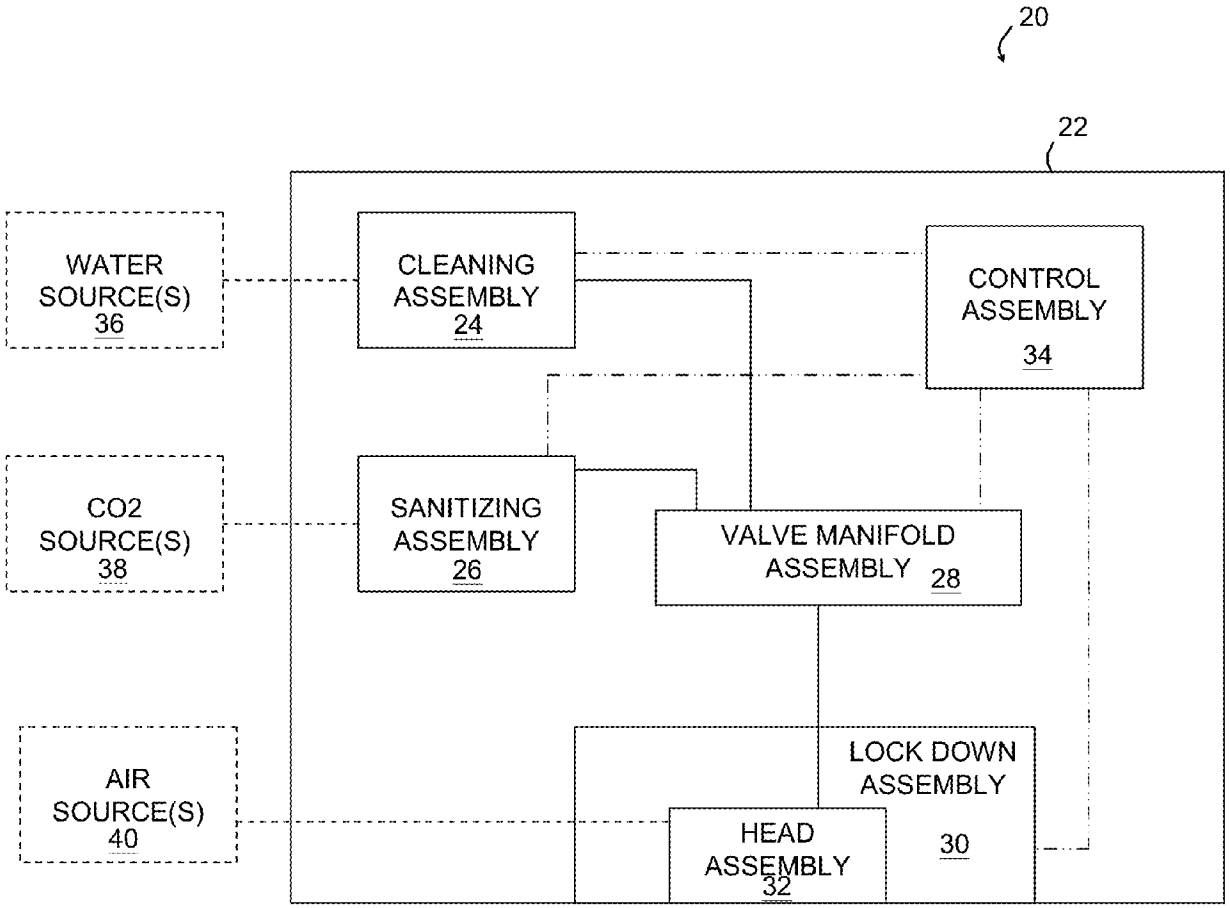
FIG. 1 is a block diagram of an example of a keg washer.

FIG. 1 shows an example of a keg washer 20. The keg washer may include any suitable structure configured to clean and/or sanitize one or more kegs. For example, the keg washer may include a frame or base assembly 22, a cleaning assembly 24, a sanitizing assembly 26, a valve manifold assembly 28, a lock down assembly 30, a head assembly 32, and a control assembly 34. The frame assembly (or base assembly) may at least partially contain and/or support one or more of the other assemblies. The cleaning assembly may include any suitable structure configured to clean one or more kegs. For example, the cleaning assembly may include a cleaning solution tank (or a caustic tank), a pump, and/or a heater. The cleaning assembly may be fluidly connected to the valve manifold assembly and/or to one or more water sources 36.

The sanitizing assembly may include any suitable structure configured to sanitize one or more kegs. For example, the sanitizing assembly may include a sanitizer solution tank (or a "sani" tank) and a pump. The sanitizing assembly may be fluidly connected to the valve manifold assembly and/or to one or more sanitizing chemical sources, such as one or more carbon dioxide sources 38. The valve manifold assembly may include any suitable structure configured to fluidly connect the cleaning and/or sanitizing assemblies to the head assembly. For example, the valve manifold assembly may include a plurality of control valves. The lock down assembly (or lock down device) may include any suitable structure configured to secure the one or more kegs to the frame assembly.

Head assembly may include any suitable structure configured to fluidly connect the keg washer to the internal compartment of the keg(s). For example, the head assembly may include one or more heads (or cleaning heads) that are configured to connect to the opening of the kegs. The head(s) may be air activated (and/or air moved) and may be fluidly connected to one or more air sources 40. The control assembly may include any suitable structure configured to allow a user to control one or more components of the keg washer, such as the cleaning assembly, sanitizing assembly, valve manifold assembly, lock down assembly, and/or head assembly. Additionally, the control assembly may be configured to allow a user to monitor operation of those components. For example, the control assembly may include a control panel.

Figure 2:
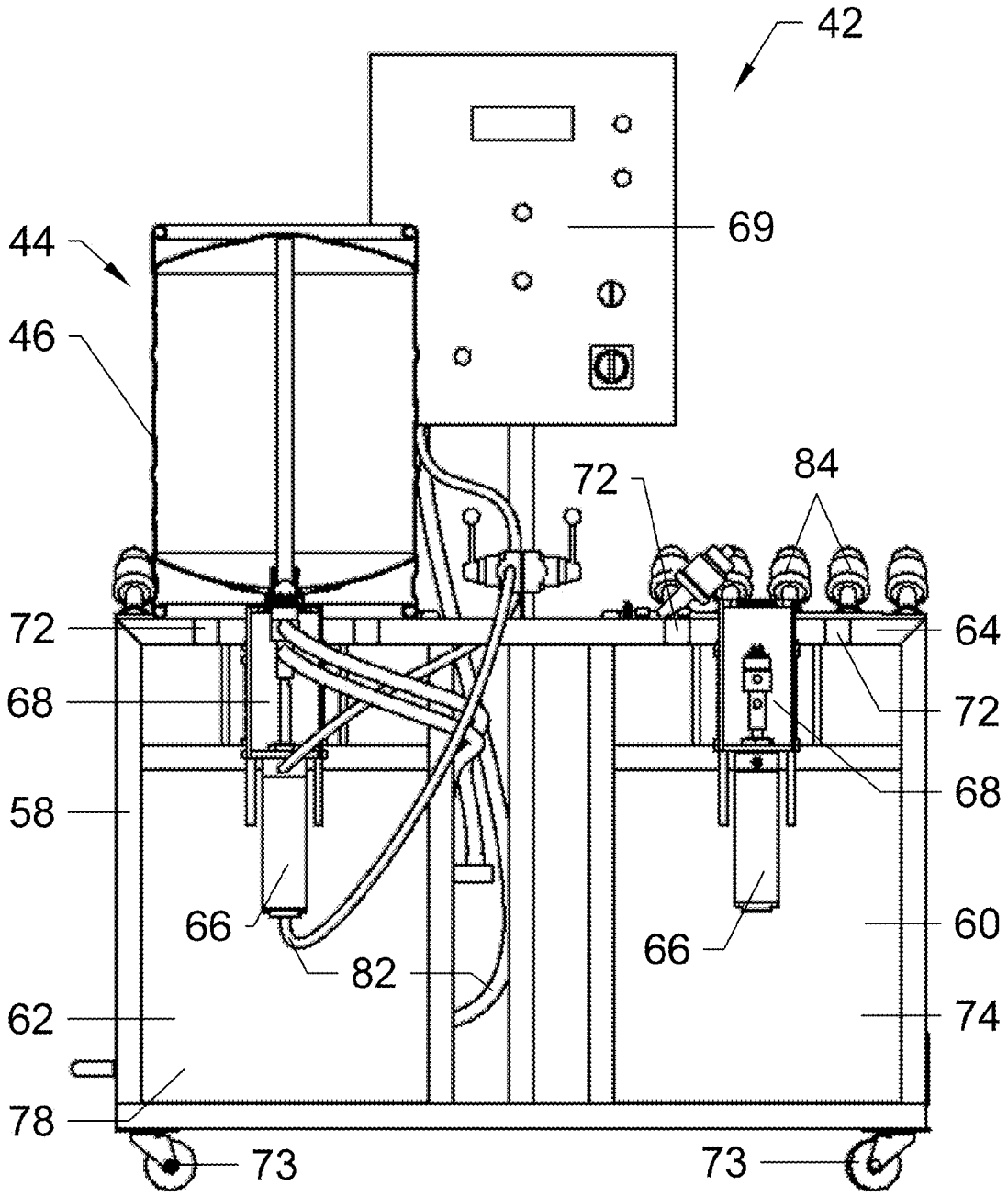
FIG. 2 is front view of an example of the keg washer of FIG. 1, shown with a keg connected to a left-side of the keg washer and shown without (a) a shell of the keg to illustrate internal components of the keg and (b) piping that connects components on a right-side of the washer to show those components.
Figure 3:
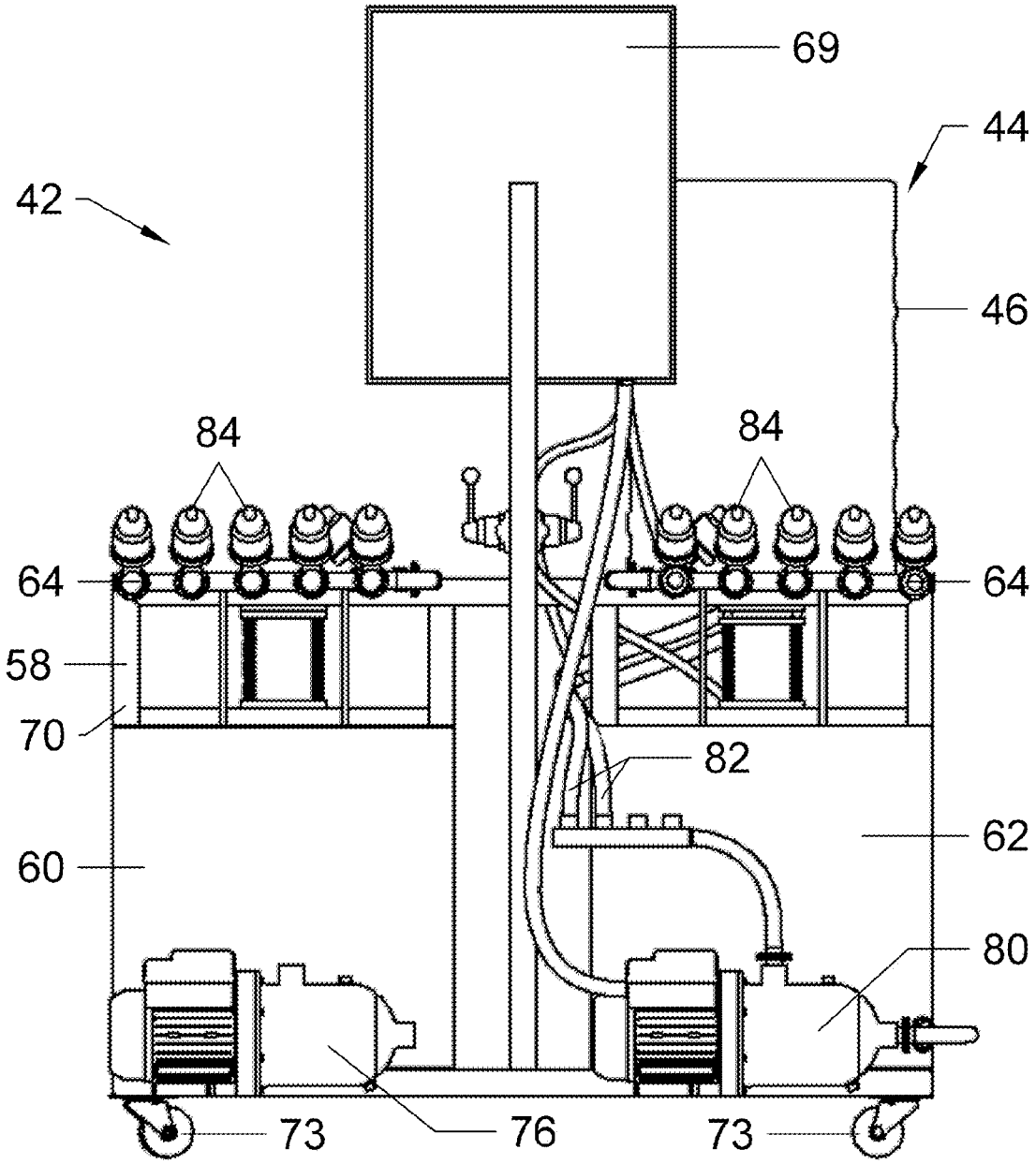
FIG. 3 is a rear view of the keg washer of FIG. 2.
Figure 8:
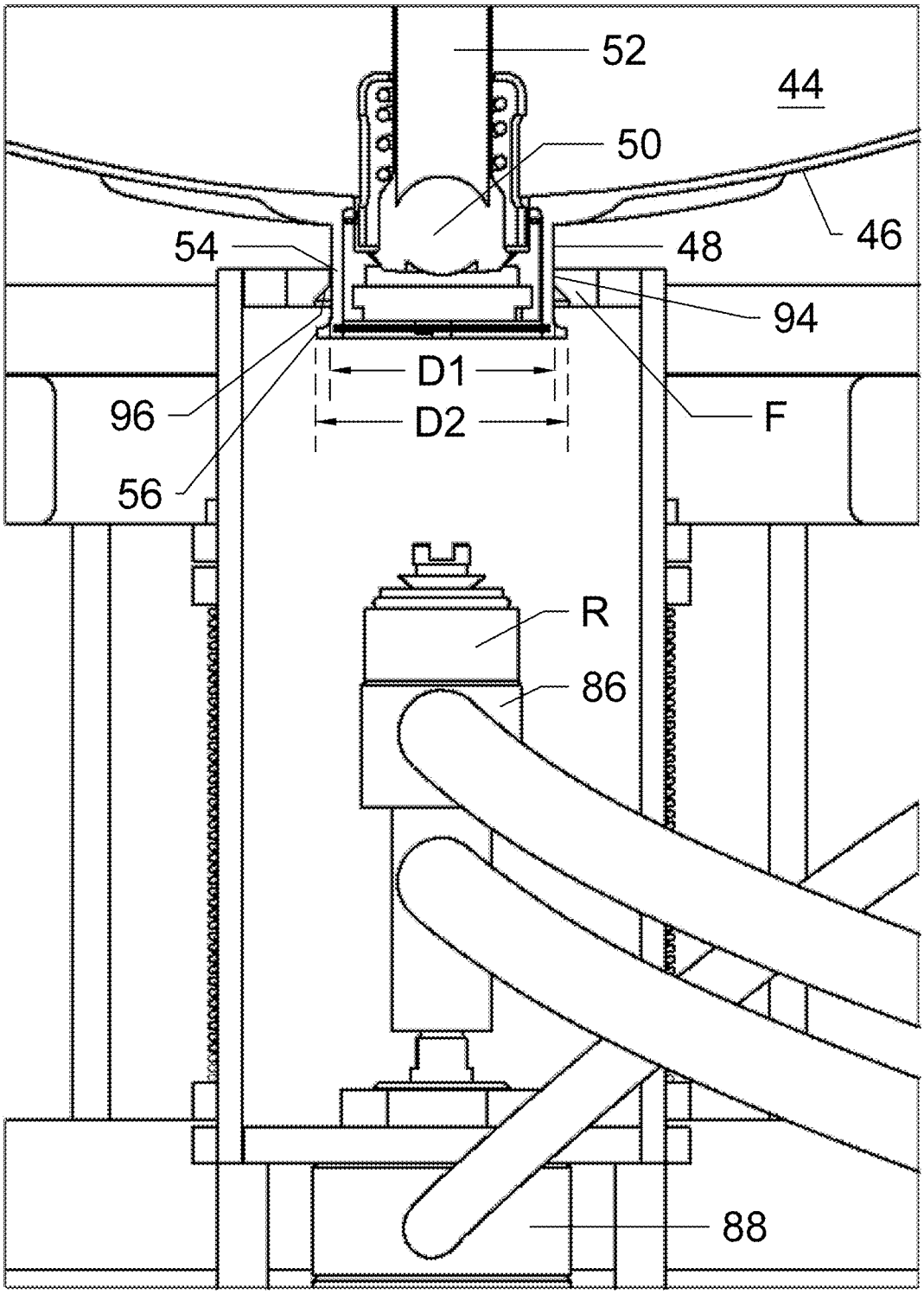
FIG. 8 is a partial front view of the keg washer of FIG. 2, showing a first neck portion of a keg received in the neck holder of FIG. 6 and with a cleaning head in a retracted position, the keg shown without a shell to illustrate internal components of the keg.

FIGS. 2-3 show an example of keg washer 20, which is generally indicated at 42. Unless explicitly stated, keg washer 42 may include one or more components and/or one or more functions of one or more other keg washers described in this disclosure. Keg washer 42 may be configured to clean and/or sanitize one or more kegs 44. The keg may include any suitable structure. For example, keg 44 may include a shell 46, a neck 48, a keg valve 50 (such as a self-closing valve) contained within the neck, and a spear 52 fluidly connected to the keg valve, as shown in FIG. 8. The neck may include a first neck portion 54 having a first diameter D1, and a second neck portion 56 having a second diameter D2. In some embodiments, the second diameter may be larger than the first diameter. In some embodiments, second neck portion may be referred to as a "keg neck ring."

Keg washer 42 may include any suitable structure. For example, keg washer 42 may include a frame or base assembly 58, a cleaning assembly 60, a sanitizing assembly 62, valve manifold assemblies 64, head assemblies 66, lock down assemblies or locking mechanisms 68, and a control assembly 69, as shown in FIGS. 2-3. Although keg washer 42 is shown to include a single base assembly, a single cleaning assembly, a single sanitizing assembly, two valve manifold assemblies, two head assemblies, two lock down assemblies, and a single control assembly, the keg washer may include any suitable number of the above assemblies. For example, keg washer 42 may include a cleaning assembly and/or a sanitizing assembly for each head assembly. Alternatively, the keg washer may include a single valve manifold assembly, a single head assembly, and/or a single lock down assembly. Moreover, the keg washer may include three or more of the valve manifold assembly, head assembly, and/or lock down assembly.

The base assembly may include any suitable structure configured to support one or more other components of keg washer 42. Base assembly 58 may be configured to support keg(s) 44 such that, for example, the first neck portion is received in a first opening of lock down assembly 68 but the second neck portion is not received in a second opening of the lock down assembly, such as when a cleaning head of head assembly 66 is in a retracted position (as further discussed below). For example, base assembly 58 may include a base frame 70 and one or more resting bars 72. In some embodiments, base assembly 44 may include a plurality of wheels 73 to facilitate movement of the keg washer.

Cleaning assembly 60 may include any suitable structure configured to clean keg(s) 44. For example, the cleaning assembly may include at least one cleaning tank 74 and at least one cleaning pump 76. The cleaning tank may be configured to store cleaning solution, and the cleaning pump may be configured to selectively deliver the cleaning solution to the valve manifold assembly, the head assembly, and/or other components of the keg washer. In some embodiments, cleaning assembly 60 may include a heater (not shown) to maintain the cleaning solution within a desired temperature range. The cleaning pump and/or heater may be controlled by control assembly 69 and/or may be operated independent of the control assembly.

Sanitizing assembly 62 may include any suitable structure configured to sanitize keg(s) 44. For example, the sanitizing assembly may include at least one sanitizing tank 78 and at least one sanitizing pump 80. The sanitizing tank may be configured to store sanitizing solution, and the sanitizing pump may be configured to selectively deliver the sanitizing solution to the valve manifold assembly, the head assembly, and/or other components of the keg washer. In some embodiments, sanitizing assembly 62 may include a heater (not shown) to maintain the sanitizing solution within a desired temperature range. The sanitizing pump and/or heater may be controlled by control assembly 69 and/or may be operated independent of the control assembly.

Valve manifold assembly 64 may include any suitable structure configured to fluidly connect the cleaning and sanitizing assemblies to the head assembly. For example, the valve manifold assembly may include a plurality of piping 82 and a plurality of control valves 84. One or more of the control valves may be controlled by control assembly 69 and/or may be operated independent of the control assembly.

Figure 4:
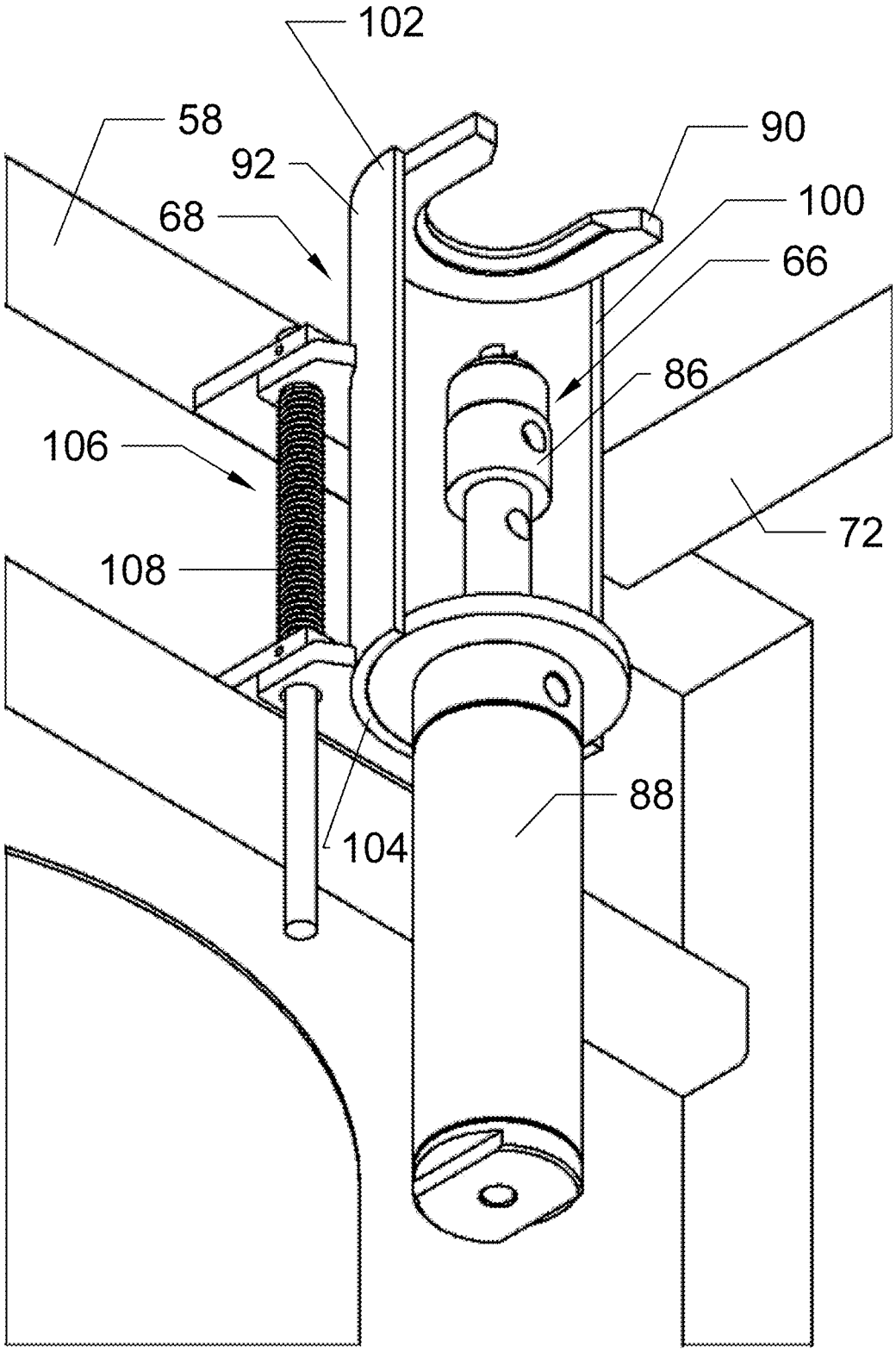
FIG. 4 is an isometric view of a locking mechanism of the keg washer of FIG. 2.
Figure 5:
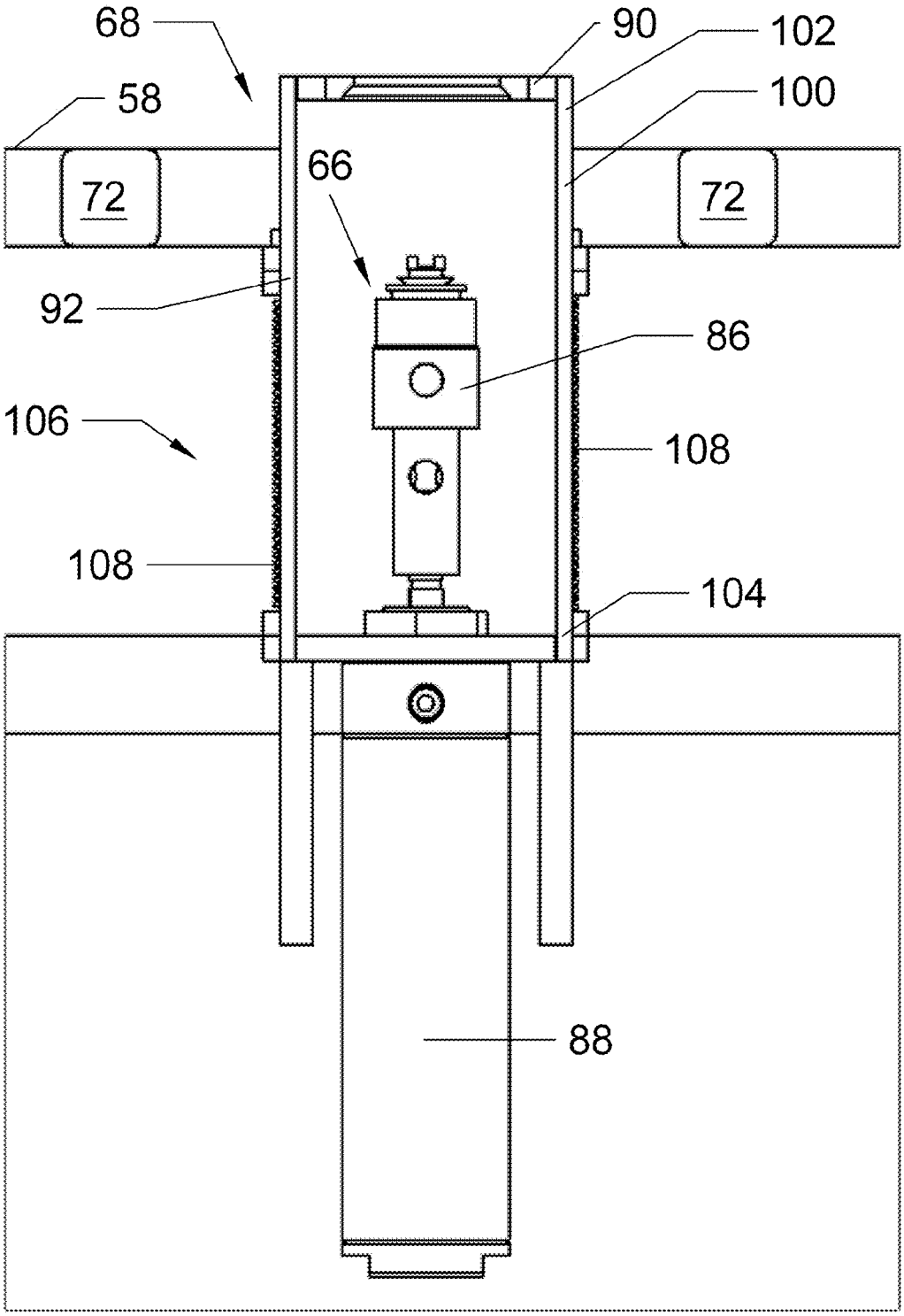
FIG. 5 is a front view of the locking mechanism of FIG. 4.

Head assembly 66 may include any suitable structure configured to fluidly connect valve manifold assembly 64 (and/or other components of the keg washer) to keg valve 50. For example, the head assembly may include one or more cleaning heads 86 and one or more head mechanisms 88, as shown in FIGS. 4-5. The cleaning head(s) may be movably connected to the base assembly and/or may be configured to connect to keg valve 50. For example, cleaning head(s) 86 may be slidably, pivotably, and/or rotatably connected to the base assembly.

Figure 10:
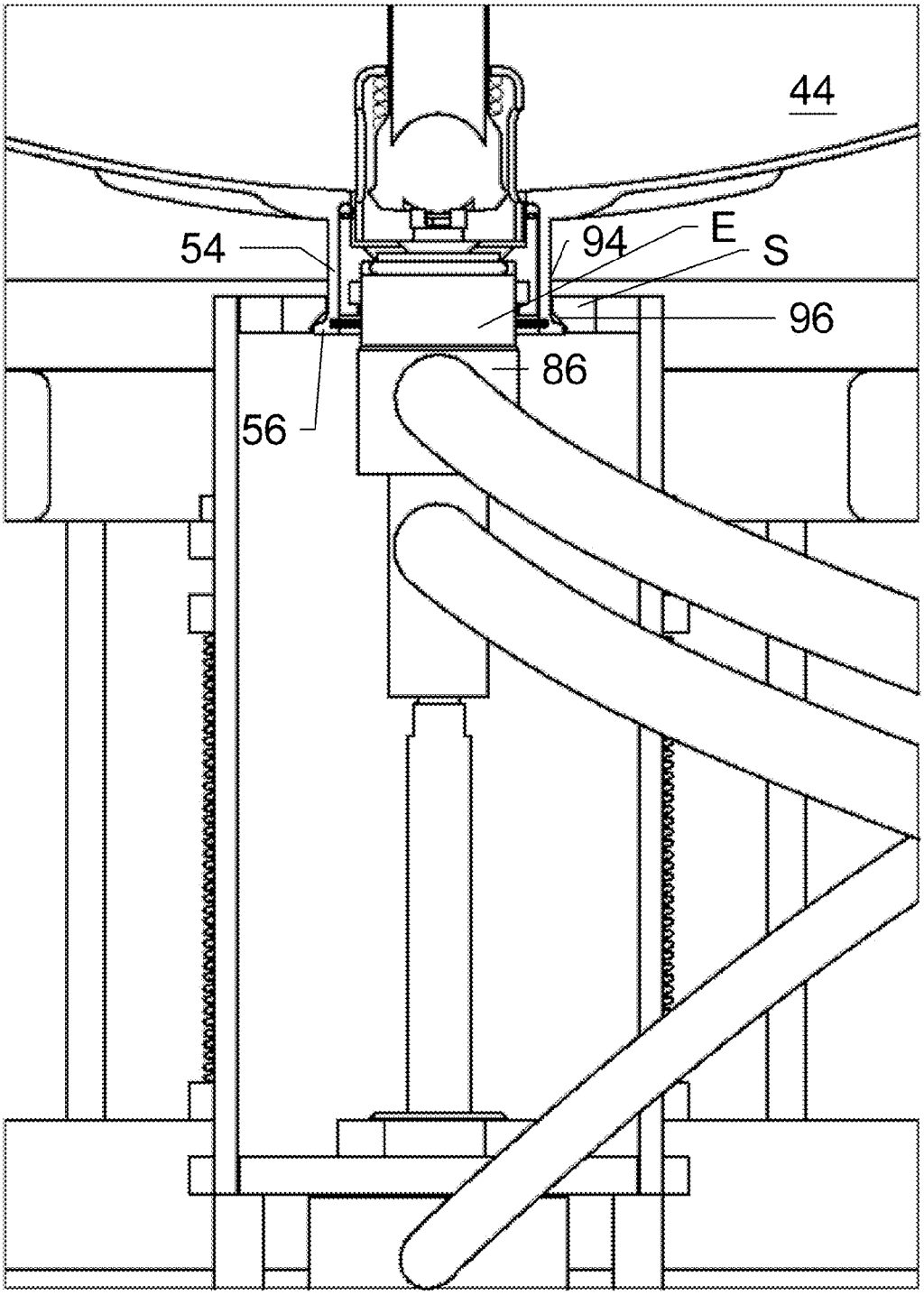
FIG. 10 is partial front view of the keg washer of FIG. 2, showing first and second neck portions of a keg received in the neck holder of FIG. 6 and with a cleaning head in the extended position and connected to a keg valve of the keg, the keg shown without a shell to illustrate internal components of the keg.

The cleaning head(s) may be configured to be moved among a plurality of positions, including between a retracted position R (such as shown in FIG. 8) and an extended position E (such as shown in FIG. 10). In the retracted position, cleaning head 86 may be spaced from keg valve 50, such as shown in FIG. 8. In the extended position, cleaning head 86 may contact and/or connect to the keg valve, such as shown in FIG. 10. Head mechanism 88 may be configured to move one or more cleaning heads 86 among the plurality of positions, including between retracted position R and extended position E via any suitable mechanisms, such as via an air-actuated cylinder or piston. The head mechanism may be controlled by control assembly 69 and/or may be operated independent of the control assembly. The cleaning and/or sanitizing assemblies may be fluidly connected to the cleaning head(s) and may be configured to provide cleaning and/or sanitizing solutions, respectively, to the cleaning head(s).

Figure 6:
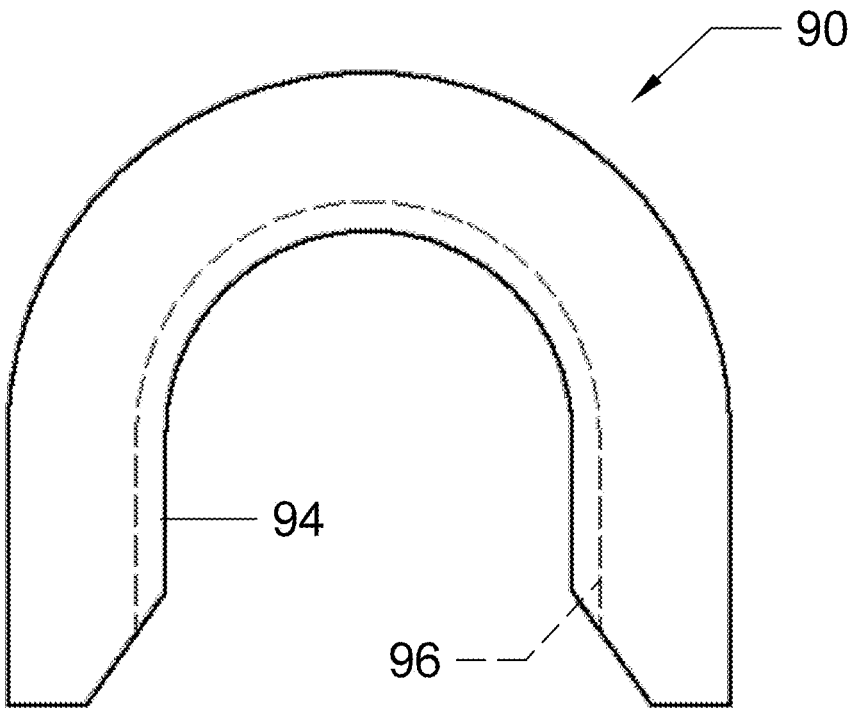
FIG. 6 is a top view of an example of a neck holder of the locking mechanism of FIG. 4.
Figure 7:
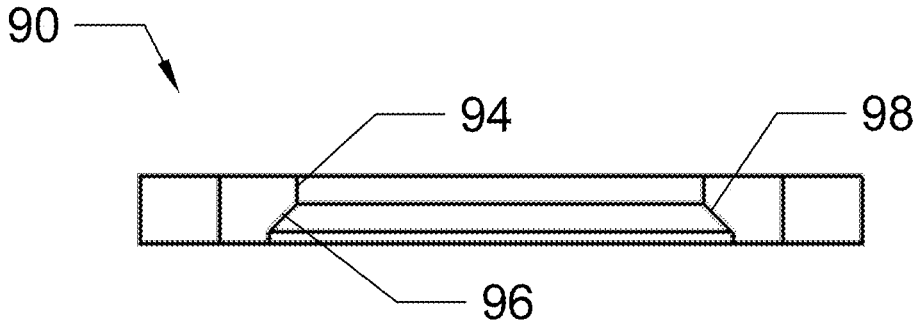
FIG. 7 is a front view of the neck holder of FIG. 6.

Lock down assembly 68 may include any suitable structure configured to secure keg(s) 44 to the base assembly. For example, the lock down assembly may include one or more neck holders 90 and one or more holder mechanisms 92, as shown in FIGS. 4-5. The neck holder may be fixedly mounted to the holder mechanism, or may be moveably mounted to the holder mechanism. Additionally, neck holder 90 may include a first opening 94 and a second opening 96, as shown in FIGS. 6-7. The first opening may be sized to receive first neck portion 54, while the second opening may be sized to receive second neck portion 56. For example, first opening 94 may have the same or similar diameter (or width) as the first neck portion, while second opening 96 may have the same or similar diameter (or width) as the second neck portion. When first neck portion has a diameter of about 2.25 inches and the second neck portion has a diameter of about 2.5 inches, then first opening may have a diameter (or width) of about 2.25 inches and the second opening may have a diameter (or width) of about 2.5 inches. Alternatively, the first and second openings may have diameters that are larger and/or smaller than the first and second neck portions, respectively.

Neck holder 90 may be a unitary material that includes one or more beveled portions 98 to provide for the first and second openings. Alternatively, the neck holder may be two or more components fastened together, such as a first component having the first opening and a second component having the second opening. Neck holder 90 may include any suitable shape(s). For example, the neck holder may be U-shaped, horseshoe-shaped, and/or other suitable shape(s).

Holder mechanism 92 may include any suitable structure configured to move neck holder 90 among a plurality of positions, including between a first position F in which first neck portion 54 is received in first opening 94 but second neck portion 56 is not received in second opening 96 (such as shown in FIG. 8), and a second position S in which the first neck portion is received in the first opening and the second neck portion is received in the second opening (such as shown in FIG. 10).

The holder mechanism may move the neck holder between the first and second positions based on movement of the cleaning heads. For example, the holder mechanism may be configured, when the cleaning head is moved from the retracted position to (or toward) the extended position, to move the neck holder from the first position to (or toward) the second position. Additionally, holder mechanism 92 may be configured, when the cleaning head is moved from the extended position to (or toward) the retracted position, to move the neck holder from the second position to (or toward) the first position.

Holder mechanism 92 may, for example, include a holder frame 100 movably connected to base assembly 58. For example, holder frame 100 may be slidably, pivotably, and/or rotatably connected to the base assembly. The holder frame may be any suitable shape(s), such as a half-pipe shape and/or other suitable shapes. Holder frame 100 may include a first frame portion 102 and a second frame portion 104. The neck holder(s) may be mounted to (such as fixedly mounted to) and/or supported by the first frame portion. The cleaning head(s) and/or head mechanism(s) may be mounted to and/or supported by the second frame portion. When the cleaning head(s) and/or head mechanism(s) are mounted to the second frame, movement of the cleaning head in a first direction may result in movement of the holder frame in a second direction (which may be opposite of the first direction), such as when the cleaning head contacts the keg valve.

Holder mechanism 92 also may include a bias assembly 106, which may include any suitable structure configured to urge the frame toward and/or away from the keg. For example, the bias assembly may be configured to urge neck holder 90 toward the first position. Bias assembly 106 may include a plurality of springs 108, such as coil springs, leaf springs, musical wire, etc. Although lock down assembly 68 is shown to be configured to secure keg(s) 54 in an inverted position to the base assembly, the lock down assembly may be configured to secure the kegs in any suitable position, such as a side and/or upright positions.

Figure 9:
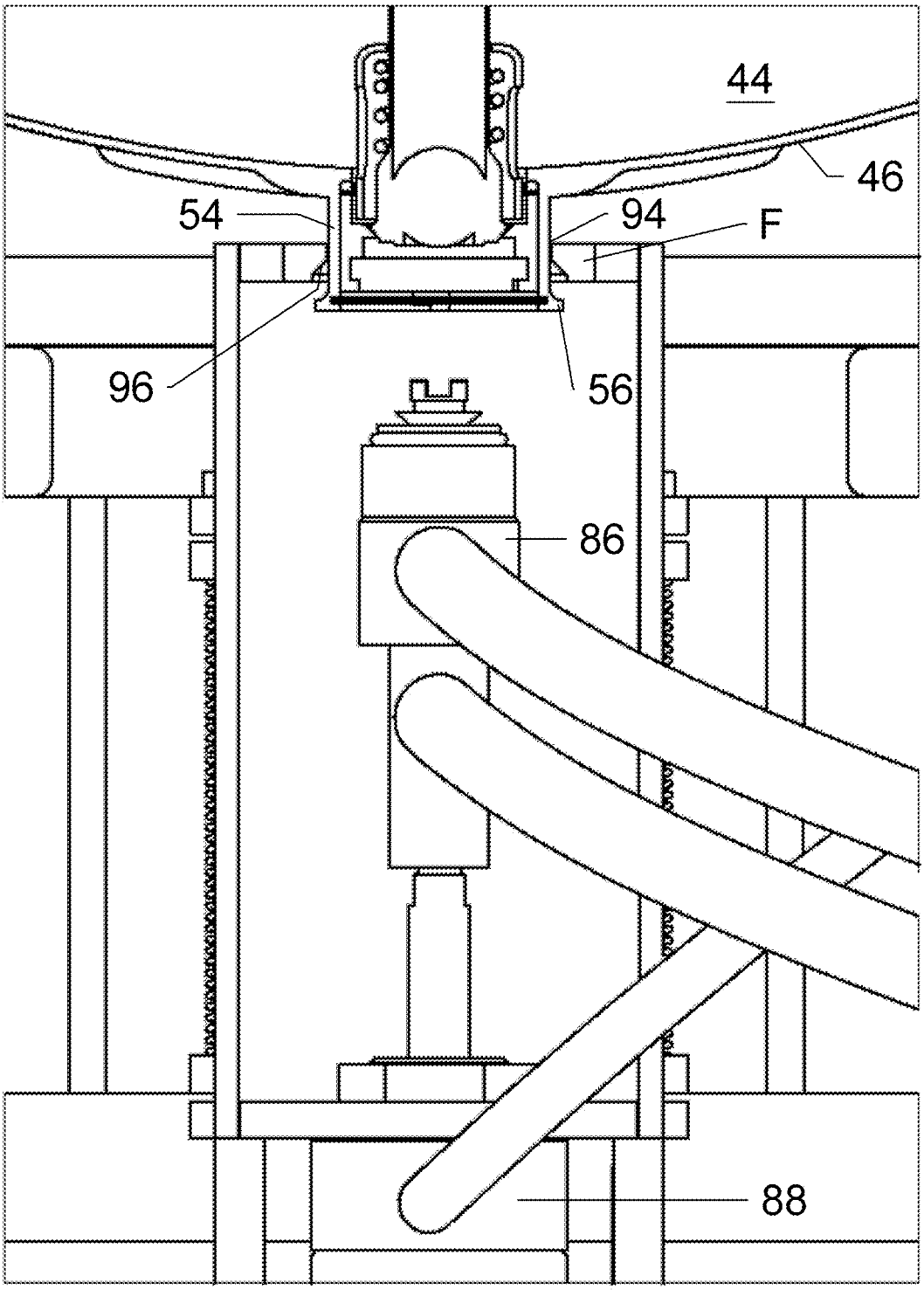
FIG. 9 is a partial front view of the keg washer of FIG. 2, showing a first neck portion of a keg received in the neck holder of FIG. 6 and with a cleaning head moving from a retracted position toward an extended position, the keg shown without a shell to illustrate internal components of the keg.

FIGS. 8-10 illustrate operation of the lock down assembly. With the cleaning head in a retracted position, a keg may be placed in an inverted position on the resting bars such that first opening receives the first neck portion but the second opening does not receive the second neck portion, as shown in FIG. 8. The head mechanism may move the cleaning head toward the extended position, as shown in FIG. 9. When the cleaning head contacts and connects to the keg valve in the extend position, the holder mechanism may move the neck holder such the first opening receives the first neck portion and the second opening receives the second neck portion, as shown in FIG. 10. With the keg secured to the base assembly and the cleaning head connected to the keg valve, cleaning and/or sanitizing solution may be sent to and/or withdrawn from the keg via the cleaning head.

When cleaning and/or sanitizing of the keg is completed, the cleaning head may be moved toward the retracted position, which may cause the holder mechanism to move the neck holder such that first opening receives the first neck portion but the second opening does not receive the second neck portion, as shown in FIG. 8. The keg may then be removed from the neck holder. Other operations may add, omit, and/or replace one or more of the above steps.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure. Where such claims recite "a" or "a first" element or the equivalent thereof, such claims should be understood to include incorporation of one or more such elements, neither requiring nor excluding two or more such elements.

What is claimed is:

1. A keg washer configured to clean a keg, the keg including a neck with first and second neck portions, the first neck portion having a first diameter and the second neck portion having a second diameter larger than the first diameter, the neck having a keg valve contained therein, the keg washer comprising:

a base assembly;

a cleaning head movably connected to the base assembly and configured to connect to the keg valve;

a head mechanism configured to move the cleaning head between a retracted position in which the cleaning head is spaced from the keg valve, and an extended position in which the cleaning head contacts and connects to the keg valve; and a locking mechanism configured to secure the keg to the base assembly, the locking mechanism including:

a holder mechanism having a holder frame movably connected to the base assembly, the holder frame having first and second frame portions, the cleaning head is mounted to the second frame portion, and a neck holder fixedly mounted to the first frame portion, the neck holder having a first opening sized to receive the first neck portion and a second opening sized to receive the second neck portion, wherein the base assembly is configured, when the cleaning head is in the retracted position, to support the keg such that the neck holder is in a first position in which the first neck portion is received in the first opening but the second neck portion is not received in the second opening, wherein the holder mechanism is configured, when the cleaning head is moved from the retracted position toward the extended position, to move the neck holder from the first position to a second position in which the first neck portion is received in the first opening and the second neck portion is received in the second opening.

2. The keg washer of claim 1, wherein the holder mechanism is configured to move the neck holder from the second position to the first position when the cleaning head is moved from the extended position toward the retracted position.

3. The keg washer of claim 1, where the first neck portion has a diameter of about 2.25 inches and the second neck portion has a diameter of about 2.5 inches, wherein the first opening has a diameter of about 2.25 inches and the second opening has a diameter of about 2.5 inches.

4. The keg washer of claim 1, wherein the neck holder is U-shaped.

5. The keg washer of claim 1, wherein the base assembly includes one or more resting bars configured to support the keg in a position in which the neck holder is in the first position when the cleaning head is in the retracted position.

6. The keg washer of claim 1, wherein the holder mechanism further includes a bias assembly configured to urge the neck holder toward the first position when the cleaning head is moved from the extended position toward the retracted position.

7. The keg washer of claim 1, wherein the holder frame is half-pipe shaped.

8. The keg washer of claim 1, further comprising a cleaning assembly fluidly connected to the cleaning head and configured to provide cleaning solution to the cleaning head.

9. The keg washer of claim 1, further comprising a sanitizing assembly fluidly connected to the cleaning head and configured to provide sanitizing solution to the cleaning head.

10. A locking mechanism configured to secure a keg to a base assembly of a keg washer, the keg including a neck with first and second neck portions, the first neck portion having a first diameter and the second neck portion having a second diameter larger than the first diameter, the neck having a keg valve contained therein, the keg washer including the base assembly, a cleaning head movably connected to the base assembly and configured to connect to the keg valve, a head mechanism configured to move the cleaning head between a retracted position in which the cleaning head is spaced from the keg valve, and an extended position in which the cleaning head contacts and connects to the keg valve, the locking mechanism including:

a holder mechanism having a holder frame movably connected to the base assembly, the holder frame having first and second frame portions, the cleaning head is mounted to the second frame portion; and a neck holder fixedly mounted to the first frame portion, the neck holder having a first opening sized to receive the first neck portion and a second opening sized to receive the second neck portion, wherein the base assembly is configured, when the cleaning head is in the retracted position, to support the keg such that the neck holder is in a first position in which the first neck portion is received in the first opening but the second neck portion is not received in the second opening, wherein the holder mechanism is configured, when the cleaning head is moved from the retracted position toward the extended position, to move the neck holder from the first position to a second position in which the first neck portion is received in the first opening and the second neck portion is received in the second opening.

11. The locking mechanism of claim 10, wherein the holder mechanism is configured to move the neck holder from the second position to the first position when the cleaning head is moved from the extended position toward the retracted position.

12. The locking mechanism of claim 10, where the first neck portion has a diameter of about 2.25 inches and the second neck portion has a diameter of about 2.5 inches, wherein the first opening has a diameter of about 2.25 inches and the second opening has a diameter of about 2.5 inches.

13. The locking mechanism of claim 10, wherein the neck holder is U-shaped.

14. The locking mechanism of claim 10, wherein the holder mechanism further includes a bias assembly configured to urge the neck holder toward the first position when the cleaning head is moved from the extended position toward the retracted position.

15. The locking mechanism of claim 10, wherein the holder frame is half-pipe shaped.

16. A keg washer configured to clean a keg, the keg including a neck with first and second neck portions, the first neck portion having a first diameter and the second neck portion having a second diameter larger than the first diameter, the neck having a keg valve contained therein, the keg washer comprising:

a base assembly;

a cleaning head movably connected to the base assembly and configured to connect to the keg valve;

a head mechanism configured to move the cleaning head between a retracted position in which the cleaning head is spaced from the keg valve, and an extended position in which the cleaning head contacts and connects to the keg valve; and a locking mechanism configured to secure the keg to the base assembly, the locking mechanism including:

a holder mechanism having a holder frame movably connected to the base assembly, the holder frame having first and second frame portions, the cleaning head is mounted to the second frame portion, and a neck holder fixedly mounted to the first frame portion, the neck holder having a first opening sized to receive the first neck portion and a second opening sized to receive the second neck portion, wherein the base assembly is configured, when the cleaning head is in the retracted position, to support the keg such that the neck holder is in a first position in which the first neck portion is received in the first opening but the second neck portion is not received in the second opening, wherein the holder mechanism is configured, when the cleaning head is moved from the retracted position toward the extended position, to move the neck holder from the first position to a second position in which the first neck portion is received in the first opening and the second neck portion is received in the second opening, the holder mechanism being further configured to move the neck holder from the second position to the first position when the cleaning head is moved from the extended position toward the retracted position, the holder mechanism including a first frame portion attached to the neck holder and a second frame portion supporting the cleaning head and a bias assembly configured to urge the neck holder toward the first position when the cleaning head is moved from the extended position toward the retracted position.

17. The keg washer of claim 16, further comprising a cleaning assembly fluidly connected to the cleaning head and configured to provide cleaning solution to the cleaning head.

18. The keg washer of claim 17, further comprising a sanitizing assembly fluidly connected to the cleaning head and configured to provide sanitizing solution to the cleaning head.

* * * * *